US008565136B2

(12) United States Patent
Mitsuhashi

(10) Patent No.: US 8,565,136 B2
(45) Date of Patent: Oct. 22, 2013

(54) DIGITAL BROADCASTING SYSTEM, AND BROADCASTING TRANSMITTER AND MONITORING DEVICE FOR USE IN THE SYSTEM

(75) Inventor: Masaru Mitsuhashi, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 678 days.

(21) Appl. No.: 11/892,636

(22) Filed: Aug. 24, 2007

(65) Prior Publication Data

US 2008/0072268 A1 Mar. 20, 2008

(30) Foreign Application Priority Data

Sep. 14, 2006 (JP) ..... 2006-250141

(51) Int. Cl.
*H04H 20/71* (2008.01)

(52) U.S. Cl.
USPC ..... 370/312; 342/463; 725/105

(58) Field of Classification Search
USPC ..... 370/203, 241; 380/30, 200; 725/105
See application file for complete search history.

(56) References Cited

U.S. PATENT DOCUMENTS

| | | | | |
|---|---|---|---|---|
| 6,446,025 | B1 * | 9/2002 | Nakamura et al. | 702/159 |
| 2004/0087291 | A1 * | 5/2004 | Wada | 455/216 |
| 2006/0233359 | A1 * | 10/2006 | Jung et al. | 380/30 |
| 2006/0268673 | A1 * | 11/2006 | Roh et al. | 370/203 |
| 2007/0069952 | A1 * | 3/2007 | Ling et al. | 342/463 |

FOREIGN PATENT DOCUMENTS

| | | | |
|---|---|---|---|
| EP | 1063799 | | 12/2000 |
| EP | 1 076 427 | B1 | 2/2001 |
| JP | 9-505965 | A | 6/1997 |
| JP | 2000-324361 | | 11/2000 |
| JP | 2000324361 | A * | 11/2000 |
| JP | 2001-285222 | A | 10/2001 |
| JP | 2003-32207 | A | 1/2003 |
| WO | WO 2005/029736 | | 3/2005 |

OTHER PUBLICATIONS

First Office Action from the State Intellectual Property Office of China, mailed Oct. 9, 2009, in related Chinese Patent Application No. 2007101496714, and English translation of the main text thereof.
Notice of Reasons for Rejection mailed Mar. 9, 2010, for Japanese Patent Application No. 2006-250141 (3 pages).
Extended European Search Report and opinion of May 28, 2013 in European Patent Application No. 07016917.2, 6 pages.

* cited by examiner

*Primary Examiner* — Andrew Lai
*Assistant Examiner* — Leon Andrews
(74) *Attorney, Agent, or Firm* — Finnegan, Henderson, Farabow, Garrett & Dunner, L.L.P.

(57) ABSTRACT

Plurality of broadcasting transmitters each receives distribution of digital broadcast signals via a network (NET) to transmit them toward an area under control by using wireless waves of which the frequencies are the same. Here, when signals transmitted from the plurality of broadcasting transmitters into the area, an occurrence of a deviation of a fixed value or more poses an interference fault and results in a reception disabled state. Therefore, monitors are provided in the area to receive wireless waves from the plurality of broadcasting transmitters, monitors reception states, and controls output power, output timing, etc., of broadcasting transmitters that are transmission origins of the received wireless waves to make the reception states appropriate.

5 Claims, 5 Drawing Sheets

DIGITAL BROADCASTING SYSTEM, AND BROADCASTING TRANSMITTER AND MONITORING DEVICE FOR USE IN THE SYSTEM

CROSS-REFERENCE TO RELATED APPLICATIONS

This application is based upon and claims the benefit of priority from prior Japanese Patent Application No. 2006-250141, filed Sep. 14, 2006, the entire contents of which are incorporated herein by reference.

BACKGROUND OF THE INVENTION

1. Field of the Invention

The present invention relates to, for example, a digital broadcasting system such as terrestrial digital television broadcasting.

2. Description of the Related Art

The terrestrial digital television broadcasting system which has been currently operated covers a desired service area through a transport stream transmitter transmitter link (TS-TTL) transmission network, intermediate frequency transmitter link (IF-TTL) network, and a broadcast wave receiving/retransmitting network. Meanwhile, in an initial development phase of the terrestrial digital television broadcasting system, application of a single frequency network (SFN) has been intended to effectively utilize a frequency. However, in actual, it is hard to fully shorten the distance between a transmitting station and a relay station, and a signal delay time difference between two signals in a receiving area shared with both stations exceeds a guard interval. Thereby, it is impossible to satisfy one condition of the SFN that is "signal delay time difference between two signals in receiving area should be within guard interval". In the relay station, it is hard to secure isolation between a reception antenna and a transmission antenna in many cases, and this case results in an obstacle of achieving the SFN.

As mentioned above, the construction of a broadcasting network through the SFN, which is planned in an initial phase, has been in a technically difficult situation, and at present, a multi-frequency network (MFN) covers main service areas. Therefore, effective utilization of frequencies is spoiled, and effect to switch analog broadcasting to digital broadcasting is reduced by half. Since it is impossible to distinguish the signal from which broadcasting station the receiving signal is transmitted when the SFN is established, such a problem that the broadcast wave in the service area cannot be optimized has been posed.

As to a technique for maintaining a reception level in a service area constant, Jpn. Pat. Appln. KOKAI Publication 2000-324361 discloses a technique to measure, by a field intensity measuring instrument, a reception level of a transmission signal transmitted from a transmission antenna, to adjust the reception level of the modulation signal by a step attenuator on the basis of the measurement result, and to control the output of the transmission signal to be transmitted constant in a digital television device to apply level adjustment to an OFDM-modulated television signal by means of the step attenuator, and to power-amplify it by a power amplifier to transmit it from the transmission antenna.

As described above, in the conventional digital broadcasting system, since it is hard to construct a broadcasting network through the SFN in a relay transmission, and it is impossible to distinguish that from which broadcasting station the reception signal is transmitted when the SFN is established, there is a problem such that the broadcast wave in the service area cannot be optimized.

BRIEF SUMMARY OF THE INVENTION

An object of the present invention is to provide a digital broadcasting system configured to construct a broadcasting network though an SFN, and a broadcasting transmitter and a monitoring device for use in the system.

A digital broadcasting system regarding the invention, in which a broadcasting network is constructed by a plurality of broadcasting transmitters which receive digital broadcast signals distributed via a cable or a wireless network to transmit the broadcast signals through the identical frequencies toward areas, a part of which is made to be common, through the identical frequencies by using wireless waves, comprises monitoring means for receiving the wireless waves transmitted from the plurality of broadcasting transmitters, respectively, at arbitrary spots to monitor reception states; and output control means for controlling outputs of the wireless waves of the arbitrary broadcasting transmitters on the basis of the reception states obtained by the monitoring means.

A broadcasting transmitter regarding the invention for use in a digital broadcasting system, in which a broadcasting network is constructed by a plurality of broadcasting transmitters which receive a digital broadcast signals distributed via a cable or a wireless network to transmit the broadcast signals toward areas, a part of which is made to be common, through the identical frequencies by using wireless waves toward areas, comprises output adjustment means for adjusting outputs of the wireless waves so that the receiving states become appropriate on the basis of the reception states obtained by monitoring the wireless waves of the broadcast signals at arbitrary spots; and processing means for distinction for applying prescribed processing to the wireless waves in order to distinguish the transmission origins of the wireless waves.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, embodiments of the invention will be described in detail with reference to the drawings.

Figure 1:
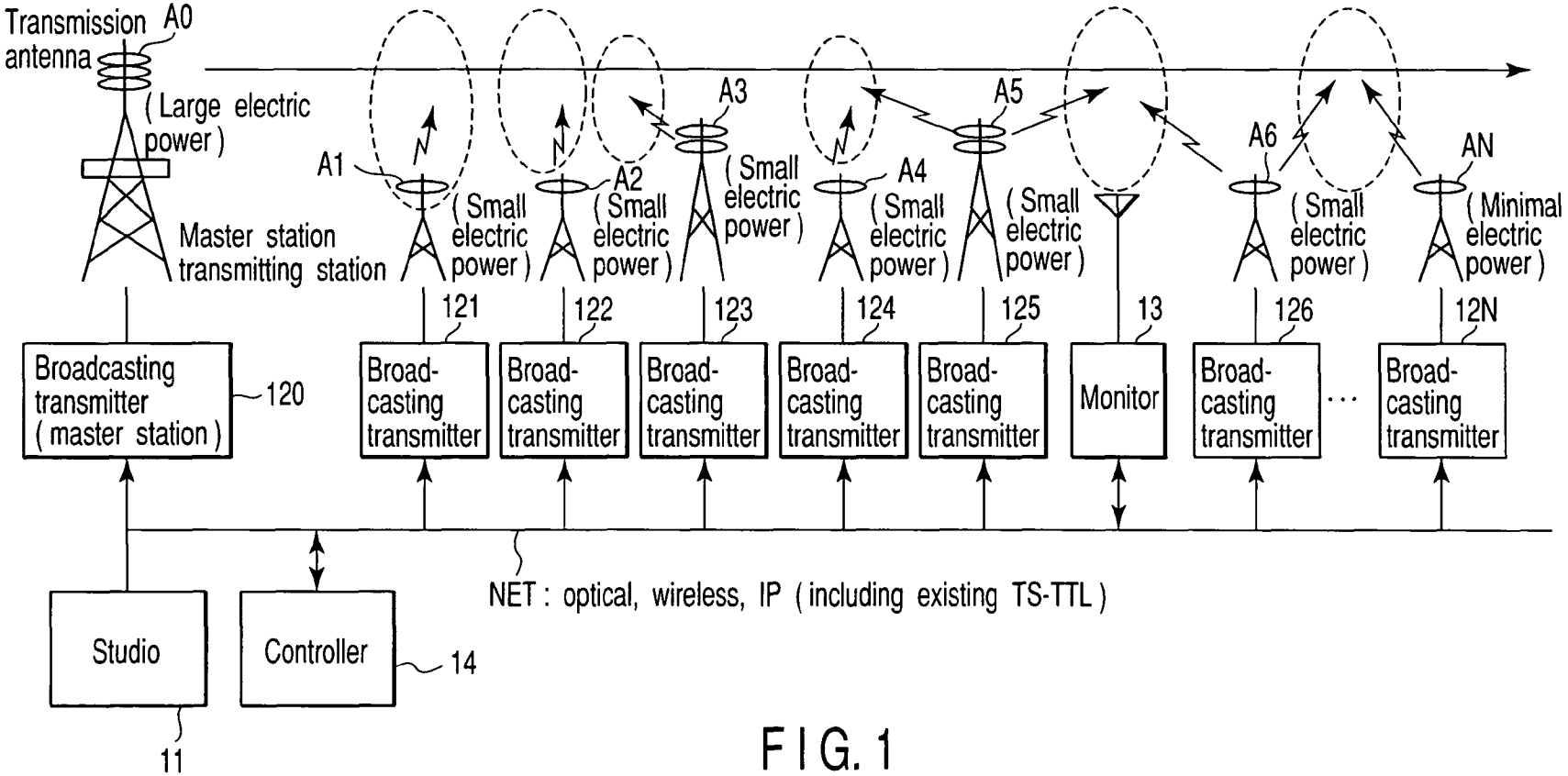
FIG. 1 is a preferred block diagram illustrating an embodiment of a terrestrial digital television broadcasting system regarding the invention.

FIG. 1 is a block diagram depicting an embodiment of a terrestrial digital television broadcasting system regarding the invention. In FIG. 1, a studio 11 converts a digital broadcasting TS to be airplyed into an internet protocol (IP) to distribute it to a broadcasting transmitter to be a master station (hereinafter referred to as master station broadcasting transmitter) via a cable/wireless network (including existing TS-TTL; however in the following description, it is presumed that an IP network is utilized as an example) NET through an optical fiber line, a wireless LAN, an IP network, etc., and also to distribute it to N pieces of broadcasting transmitters (hereinafter, to distinguish from master station, referred to as slave station broadcasting transmitter) 121-12N to be arranged in a service area controlled by the broadcasting transmitter 120.

Figure 2:
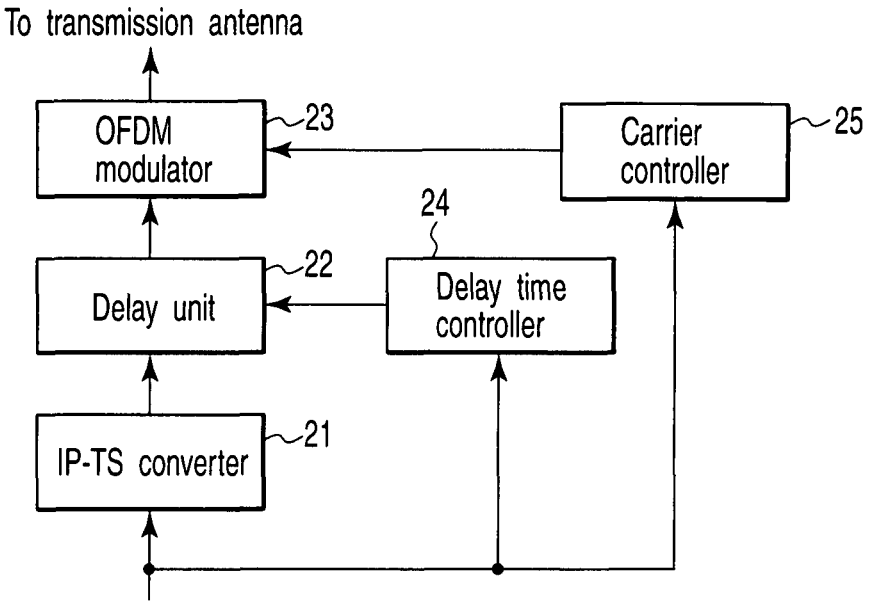
FIG. 2 is a preferred block diagram illustrating a concrete configuration of a broadcasting transmitter of the system illustrated in FIG. 1.

Each broadcasting transmitter 120-12N has the identical configuration and configured as shown in FIG. 2. In FIG. 2, a network-distributed IP digital broadcast signal is supplied to an IP-TS converter 21 to be converted into the digital broadcast TS, after it is delayed by a prescribed time by a delay unit 22, it is OFDM-modulated by an OFDM modulator 23, and it is transmitted toward a service area being under control from transmission antennas A0-AN shown in FIG. 1. Here, the delay time of the delay unit 22 is controlled by a delay time controller 24. The carrier phase and amplitude (signal level) of the modulator 23 is controlled by a carrier controller 25.

The foregoing master station broadcasting transmitter 120 transmits the digital broadcast signal from a transmission antenna A0 of the master station transmitting station to the whole of the service area under the control by a large amount of power. In contrast, the slave station broadcasting transmitters 121-12N disposed in the service area transmit the digital broadcast signals with necessary and sufficient power toward, for example, an area impossible to be covered by the master station. Monitors (only one monitor is depicted in FIG. 1) 13 are disposed in each service area (mainly border section) of the broadcasting transmitters 120-12N.

Figure 3A:
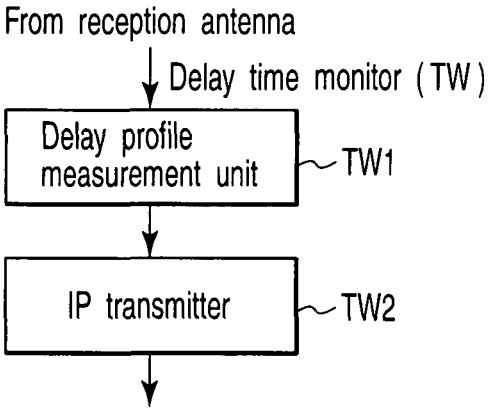
FIG. 3A and FIG. 3B are preferred block diagrams illustrating configurations of delay time monitoring unit and a carrier monitoring unit of a monitoring illustrated in FIG. 1, respectively.
Figure 3B:
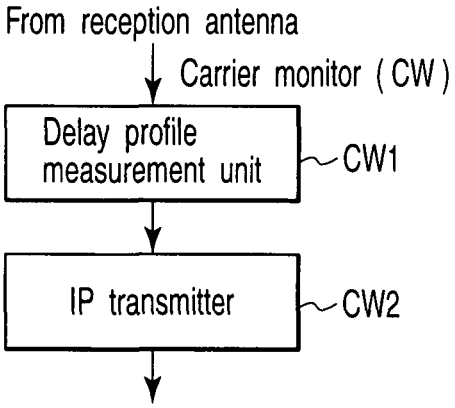

The monitor 13 has a delay time monitoring unit TW and a carrier monitoring unit CW. The monitoring unit TW measures, as depicted in FIG. 3A, inputs the reception signal received by the reception antenna to a delay profile measuring unit TW1 to measure delay profiles related to each delay time of the broadcasting transmitters, and converts the measurement result in to the IP through an IP transmitter TW2, and notifies the IP to a controller 14 via the network NET. The carrier monitoring unit CW inputs, as shown in FIG. 1, the reception signal received by the reception antenna to a delay profile measuring unit CW1 to measure delay profiles related to each signal level of the broadcasting transmitter, converts the measurement result into the IP through the OP transmitter TW2, and notifies the IP to the controller 14 via the network NET. Because the configurations of the monitoring units TW and CW are similar to each other, the same function may be shared.

Figure 5:
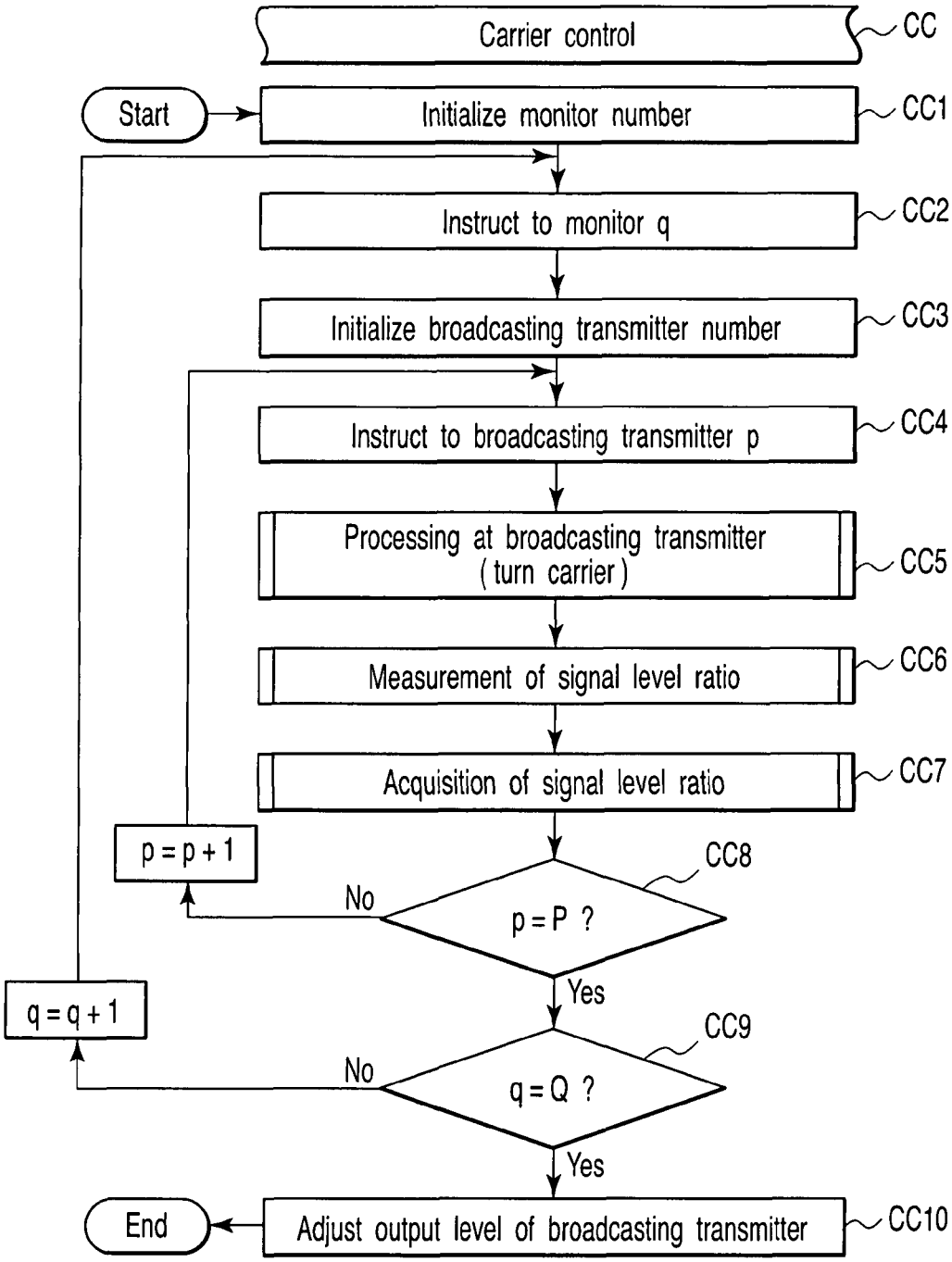
FIG. 5 is a preferred flowchart illustrating a flow of a carrier control processing of the controller illustrated in FIG. 1.

Each broadcasting transmitter 120-12N controls the delay time of the delay unit 22 and controls the carrier phase of the OFDM modulator 23 on the basis of the delay profile from the monitor 13 in accordance with delay time control processing (TC) shown in FIG. 1 and with carrier control processing (CC) shown in FIG. 5 of the controller 14. The integrated delay and the output power (output signal level) control of the whole system are implemented by the controller 14 to be connected to the network NET.

In the configuration given above, processing content to achieve the SFN will be described hereinafter. In the following description, the device number of the monitor is set to q (maximum value Q), and the device number of the broadcasting transmitter is set to p (maximum number P).

Firstly, in the monitor 13, the input signal to the monitor unit TW is the OFDM reception signal. The measuring unit TW1 measures the delay time of the broadcasting transmitter to be detected from the OFDM reception signal to notify the measurement result to the controller 14. Similarly, the input signal to the monitoring unit CW is also the OFDM reception signal. The measuring unit CW1 measures the ratio of reception levels of the broadcasting transmitters to be detected from the OFDM reception signal to notify the measuring result to the controller 14.

The measuring units TW1 and CW1 frequency-converts the OFDM reception signal to apply the OFDM demodulation and obtains the OFDM signal on a frequency axis. The measuring units TW1 and CW1 then obtains a transmission path property of the frequency axis of the reception signal by using a scattered pilot (SP) signal arranged in the OFDM signal on the frequency axis. A transmission path property of a time axis is obtained by applying inverse discrete Fourier transform (IDFT) to the transmission path property of the reception signal. This results in the delay profile.

Figure 6A:
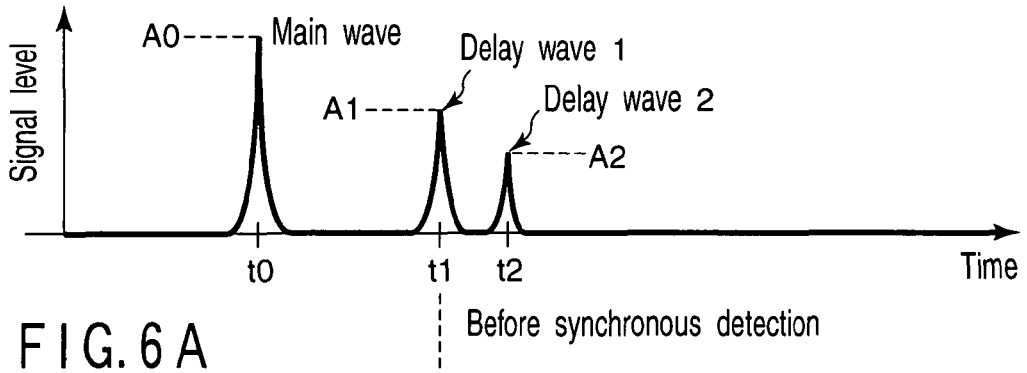
FIG. 6A and FIG. 6B are preferred view illustrating aspects of before and after adjustment of delay profiles measured by the monitor illustrated in FIG. 1, respectively.
Figure 6B:
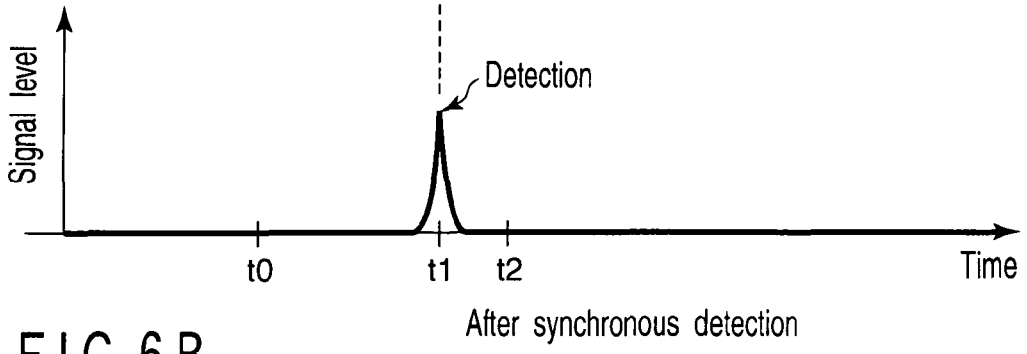

The delay profiles are, for example, depicted in FIG. 6A and FIG. 6B. On the delay profile, as shown in FIG. 6A, signals output from each broadcasting transmitter are expressed as a multi-pass. The delay profiles are performed synchronous detection by the delay time control (TC) given below. This synchronous detection means to multiply and accumulate the delay profiles by a carrier frequency deviation transferred from the delay time controller. The synchronous detection leaves, as shown in FIG. 6B, only the synchronized signal component on the delay profile. The synchronous detection then detects the delay time of a wireless wave from the slave station to a main wave from the master station in the monitor 13 from the signal remaining in the delay profile, and detects the ratio of reception levels at the monitor 13 from the signal level remaining in the delay profile and other signal levels.

Figure 4:
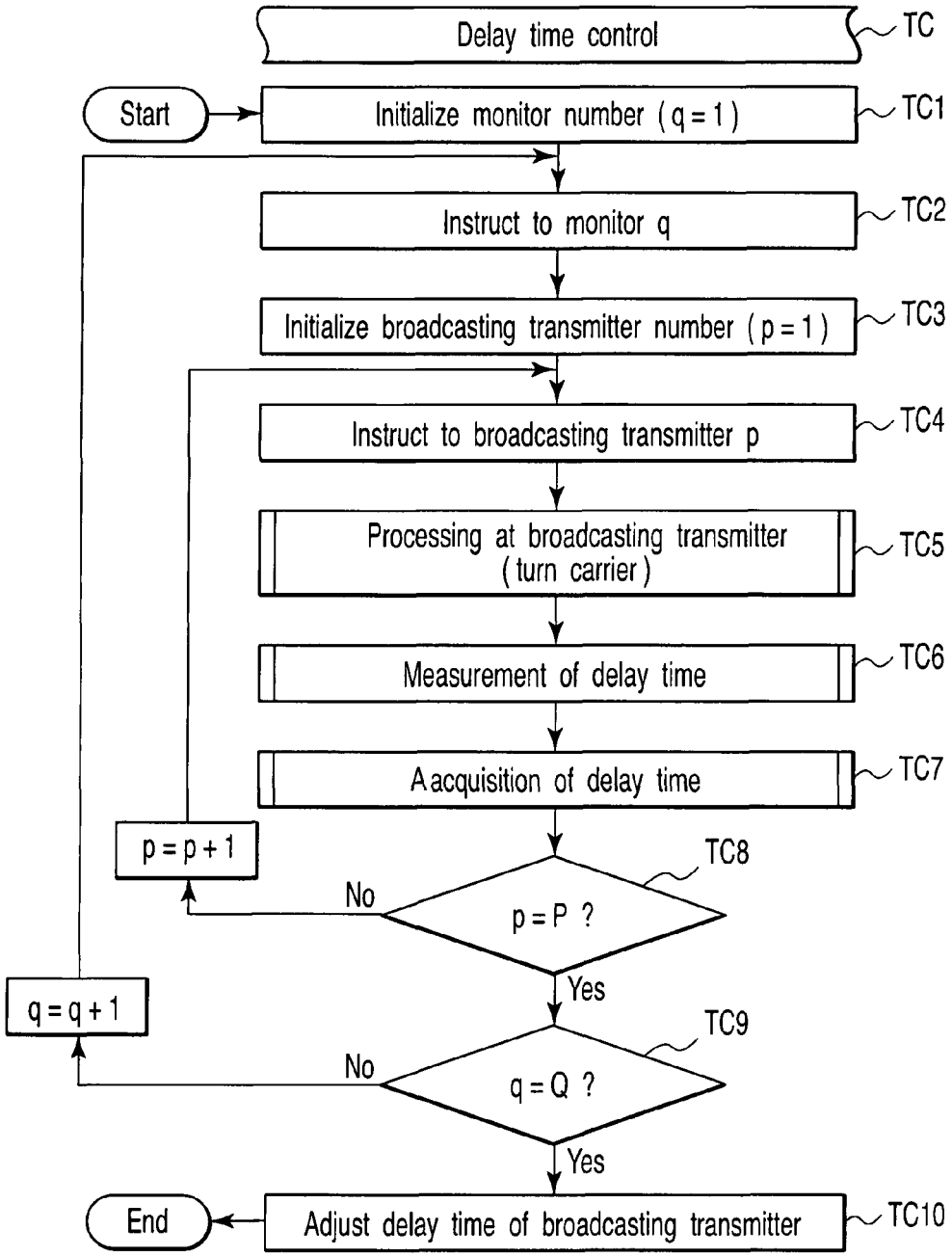
FIG. 4 is a preferred flowchart illustrating a flow of delay time control processing of a controller illustrated in FIG. 1.

The controller 14 puts the numbers (max=P: variable p) to the broadcasting transmitters in the service area to manage them, puts the numbers (max=Q: variable q) to the monitors in the service area, and executes the delay time control processing (TC) shown in FIG. 4, and the carrier control processing (CC) shown in FIG. 5. The input to the control processing (TC) is a delay time acquired by the delay time monitoring unit TW, and the output thereform is used to control the delay controller 24 of the broadcasting transmitter. The input to the control processing (CC) is a signal level ratio acquired by the carrier monitoring unit (CW), and the output thereform is used to control the carrier controller 25 of the broadcasting transmitters.

The processing procedure of the control processing (TC) depicted in FIG. 4 will be described. The control processing (TC) firstly initializes the number (q) of the monitor 13 (q=1) (step TC1). Next, in initialization and increment, the control processing (TC) instructs the monitor 13 to start the control of the delay time (step TC2). On the other hand, the control processing (TC) initializes the numbers (p) of the broadcasting transmitter 120-12N to be monitoring objects (p=1) (step TC3). The control processing (TC) then instructs the broadcasting transmitter p to start the control of the delay time in initialization and increment (step TC4).

The broadcasting transmitter p which has given the instruction changes the phase of the carrier by means of the instruction pattern from the controller 14, or the prescribed pattern (shift carrier frequency by frequency deviation) (TC5). Meanwhile, the monitor 13 generates the carrier to change by means of the instruction pattern from the controller 14 or the prescribed pattern (shift carrier frequency by frequency deviation), and extracts a variation pattern of the carrier frequency by performing the synchronous detecting through the carrier of the generated carrier. The control processing (TC) obtains a delay profile related to the reception signal having this variation pattern, measures the delay time of the specified transmission station from the delay profile (step TC6), and notifies the measurement result to the controller 14 (step TC7).

The controller 14 determines whether or not the number p if the broadcasting transmitter has become the maximum value P (step TC8), and repeatedly executes the processing in the steps TC4-TC7 until the number p becomes the maximum value P. Next, the controller 14 determines whether or not the number q of the monitor 13 has become the maximum Q (step TC9), repeatedly executes the processing in the steps TC2-TC8 until the number q becomes the maximum Q. The controller 14 notifies the delay time which has been acquired through the aforementioned processing to the corresponding broadcasting transmitter to adjust the delay time of the delay unit 22 through the delay time controller 24 then matches the output signals of the respective broadcasting transmitters with a space wave in the service area (step TC10). The given processing ends the series of the delay time control processing.

In succession, the processing procedure of the carrier control processing (CC) shown in FIG. 5 will be described. The control processing (CC) firstly initializes the number (q) of the monitor 13 (q=1) (step CC1). The control processing (CC) then instructs the monitor 13 to start the carrier control (step CC2). Meanwhile, the control processing (CC) initializes the number (p) of the broadcasting transmitters 120-12N to be monitoring objects (p=1) (step CC3). Next, in the initialization and increment, the control processing (CC) instructs the broadcasting transmitter p to start the carrier control (step CC4).

The broadcasting transmitter p which has given the instruction changes the phase of the carrier in accordance with the instruction pattern or with the prescribed pattern (shift carrier frequency by frequency deviation) (CC5). On the other hand, the monitor 13 generates the carrier to change (shift carrier frequency by frequency deviation) in accordance with the instruction pattern or with the prescribed pattern, and extracts the variation pattern of the carrier frequency by performing the synchronous detection through the carrier. The control processing (CC) acquires the delay profile for the reception signal having this variation pattern, measures the signal level ratio from the delay profile (step CC6), and notifies the measurement result to the controller 14 (step CC7).

The controller 14 determines whether or not the number q of the monitor 13 becomes the maximum value Q (step CC8), and repeatedly executes the processing of the steps CC4-CC7 until the number p reaches the maximum value P. In succession, the controller determines whether or not the number q of the monitor 13 reaches the maximum value Q (step CC9), and repeatedly executes the processing in the steps CC2-CC8. The control processing notifies the signal level ratio obtained through the foregoing processing to the corresponding broadcasting transmitter to adjust the signal level of the carrier of the OFDM modulator 23 through the carrier controller 24 (step CC10). Given processing ends the series of the carrier control processing.

The given control processing adjusts the output signal levels from each broadcasting transmitter so as to make the reception field in the service are optimum. Here, the expression "make reception field optimum" means to make the reception area maximum by taking into account the fact that excessive amplitude of the output signals from each broadcasting transmitter results in exceed of the guard interval at the reception point produces multipath, so that the SFN cannot be established, and that too small amplitude of the output signals results in shortage of reception field strength and in impossibility of provision of the broadcasting service.

The controlling units TC and CC may share the parts of the identical functions. It takes a long time for the controller 14 to measure because it performs the measurement for all of broadcasting transmitters so as to fill in a matrix (p×q). Therefore, if a detection component is almost zero, it is preferable to omit it from the measurement object.

As mentioned above, in the digital broadcasting system with the given configuration, the monitors 13 are installed in the areas of each broadcasting transmitter 120-12N, the monitors 13 respectively receive wireless waves from the broadcasting transmitters 120-12N in turn to monitor the reception states, and notifies the reception states for each broadcasting transmitter that is the transmission origin to the controller 14. The controller 14 receives the notification of the reception states from the monitors 13 to control the output power and the output timing of the wireless waves from each broadcasting transmitter 120-12N so that the reception states become appropriate.

Therefore, according to the terrestrial digital television broadcasting system based on the given configuration, the broadcast radio waves of the outputs from the respective broadcasting transmitters installed in the service area can be optimized, and the broadcasting network through the SFN can be established.

By the way, although the embodiment has been described in the case in which the broadcasting system notifies the delay time and the signal level ratio obtained by the monitors 13 to the controller 14, and notifies the delay time and the signal level ratio from the controller 14 to the corresponding broadcasting transmitters 120-12N, the monitors 13 may cooperate with each broadcasting transmitter 120-12N to directly notify the monitoring results to the broadcasting transmitters that are the transmission origins. In this case, it is needed to distinguish the broadcasting transmitters that are the transmission origins from the reception signals.

As for the methods of the monitors 13 to distinguish the transmission origins of the reception signals, the following two methods are possible approaches. In a first method, the broadcasting transmitters 120-12N vary the carrier phases of the wireless waves by the patterns deferring from one another, and the monitors 13 perform synchronous detection for the carrier variation patterns of the reception signals of the wireless waves to distinguish the transmission origins from the patterns. In a second method, the broadcasting transmitters 120-12N add distinction signs deferring from one another to the wireless waves to transmit them, and the monitors 13 determine the distinction signs from the reception signals of the wireless waves to distinguish the transmission origins. Thereby the broadcasting system may ease the integral control by the controller 14.

As described above, in the digital broadcasting system regarding the invention, each broadcasting transmitter receives the distribution of the digital broadcast signal through the cable or wireless network to transmit it to the areas in which a part of them is made to be common through the identical frequencies by using the wireless waves. Here, if deviation of a fixed value or more occurs in the signals transmitted from a plurality of broadcasting transmitters, an interference fault poses the problem of the reception disabled state. Therefore, the system is provided with monitors to monitor the reception states by receiving the wireless waves from the plurality of broadcasting transmitters, and controls the output power, output timing, etc., from the broadcasting transmitters of the transmission origins of the received wireless waves so as to make the reception states appropriate.

As for the method to distinguish the transmission origins of the reception signals by means of the monitors, here, the broadcasting transmitters vary the carrier phases of wireless waves through the patters differing from one another. Or the broadcasting transmitters add distinction signs differing from one another to the wireless waves to transmit them. The monitors perform the synchronous detection of the carrier variation patterns for the reception signals of the wireless waves to distinguish the transmission origins from the patterns to distinguish the transmission origins by distinction signs from the reception signals of the wireless waves.

It is our intention that the invention is not limited to the specific details and representative embodiments shown and described herein, and in an implementation phase, this invention may be modified in various forms without departing from the spirit or scope of the general inventive concept thereof. Various types of the invention can be formed by appropriately combining a plurality of constituent elements disclosed in the foregoing embodiments. Some of the elements, for example, may be omitted from the whole of the constituent elements shown in the embodiments mentioned above. Further, the constituent elements over different embodiments may be appropriately combined.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A digital broadcasting system in which a broadcasting network is constructed using a plurality of broadcasting transmitters which receive digital broadcast signals distributed via a cable or a wireless network to transmit the digital broadcast signals through identical frequencies toward areas, a part of which is made to be common, through the identical frequencies by using wireless waves, comprising:

a monitoring unit to receive the wireless waves transmitted from the plurality of broadcasting transmitters, respectively, at arbitrary spots to monitor reception states, wherein the monitoring unit comprises a first measuring unit configured to measure a delay of the received wireless waves, and a second measuring unit configured to measure a ratio of reception levels of the received wireless waves; and an output controller to control outputs of the wireless waves of arbitrary broadcasting transmitters on the basis of the delay and the ratio measured by the monitoring unit; wherein the plurality of broadcasting transmitters vary carrier phases of the wireless waves by carrier variation patterns differing from one another, the monitoring unit identifies transmission origins by performing synchronous detection of the carrier variation patterns for reception signals of the wireless waves and by extracting carrier vibration patterns corresponding to the carrier phases of the wireless waves, and notifies the reception states to the transmission origins.

2. The broadcasting system according to claim 1, wherein the plurality of broadcasting transmitters include an output power adjustment unit to adjust output power in accordance with control instructions from the output controller.

3. The broadcasting system according to claim 1, wherein the plurality of broadcasting transmitters include an output timing adjustment unit to adjust output timing in accordance with control instructions from the output controller.

4. A broadcasting transmitter of digital broadcasting system for use in a digital broadcasting system in which a broadcasting network is constructed using a plurality of broadcasting transmitters which receive digital broadcast signals distributed via a cable or a wireless network to transmit the digital broadcast signals toward areas, a part of which is made to be common, through identical frequencies by using wireless waves toward areas, comprising:

an output adjustment unit to adjust outputs of the wireless waves so that receiving states become appropriate on the basis of reception states obtained by monitoring the wireless waves of the broadcast signals at arbitrary spots, the reception states including a delay of the received wireless waves and a ratio of reception levels of the received wireless waves, wherein the monitoring comprises measuring the delay and measuring the ratio; and a distinction processing unit to apply prescribed processing to the wireless waves in order to distinguish the transmission origins of the wireless waves, wherein the distinction processing unit varies carrier phases of the wireless waves by prescribed patterns to transmit them.

5. A monitor for use in a digital broadcasting system in which a broadcasting network is constructed using a plurality of broadcasting transmitters which receive digital broadcast signals to be distributed via a cable or a wireless network to transmit the broadcast signals toward a recipient through identical frequencies by using the wireless waves, and for receiving the wireless waves from the plurality of broadcasting transmitters to monitor reception states, comprising:

a first measuring unit configured to measure a delay of received wireless waves, and a second measuring unit configured to measure a ratio of reception levels of the received wireless waves;

a distinction unit to distinguish transmission origins from received wireless waves; and a notification unit to notify the reception states, including the measured delay and the measured ratio, to the broadcasting transmitters of the transmission origins distinguished by the distinction unit, wherein the distinction unit performs synchronous detection to wireless waves transmitted in prescribed carrier variation patterns to distinguish transmission origins from the patterns.

* * * * *